US008763685B2

(12) United States Patent
Robin

(10) Patent No.: US 8,763,685 B2
(45) Date of Patent: Jul. 1, 2014

(54) WHIPSTOCK ASSEMBLY AND METHOD FOR LOW SIDE EXIT

(75) Inventor: Andrew M. Robin, Ellon (GB)

(73) Assignee: Baker Hughes Incorporated, Houston, TX (US)

( * ) Notice: Subject to any disclaimer, the term of this patent is extended or adjusted under 35 U.S.C. 154(b) by 161 days.

(21) Appl. No.: 13/291,745

(22) Filed: Nov. 8, 2011
(Under 37 CFR 1.47)

(65) Prior Publication Data

US 2013/0025864 A1 Jan. 31, 2013

Related U.S. Application Data

(60) Provisional application No. 61/511,293, filed on Jul. 25, 2011.

(51) Int. Cl.
*E21B 23/12* (2006.01)
*E21B 7/08* (2006.01)

(52) U.S. Cl.
USPC ..... 166/117.6; 166/117.5; 175/81

(58) Field of Classification Search
USPC ..... 166/117.5, 117.6, 255.3; 175/75, 80–81
See application file for complete search history.

(56) References Cited

U.S. PATENT DOCUMENTS

| | | | | |
|---|---|---|---|---|
| 2,043,381 | A * | 6/1936 | Lane | 166/117.5 |
| 2,197,344 | A * | 4/1940 | Matlock | 175/294 |
| 4,397,355 | A * | 8/1983 | McLamore | 166/297 |
| 5,109,924 | A | 5/1992 | Jurgens et al. | |
| 5,222,554 | A | 6/1993 | Blount et al. | |
| 5,452,759 | A | 9/1995 | Carter et al. | |
| 5,584,350 | A * | 12/1996 | Schnitker et al. | 175/61 |
| 2002/0070018 | A1 | 6/2002 | Buyaert | |
| 2006/0027359 | A1 * | 2/2006 | Carter et al. | 166/117.6 |
| 2006/0037759 | A1 | 2/2006 | Braddick | |

OTHER PUBLICATIONS

International Search Report and Written Opinion, Date of Mailing Jan. 14, 2013, International Application No. PCT/US2012/045686, International Search Report 8 pages; Written Opinion 4 pages.

* cited by examiner

*Primary Examiner* — Giovanna Wright
(74) *Attorney, Agent, or Firm* — Cantor Colburn LLP

(57) ABSTRACT

A whipstock assembly allowing a lowside casing exit, the whipstock assembly includes a whipstock including an upstream portion and a downstream portion, the upstream portion having a deflection wedge surface and an opposite casing-side surface; and a fulcrum protruding from the whipstock and positioned between the downstream portion and the upstream portion. Also includes is a method of allowing a first side exit in a window milling operation of a casing having a first side and an opposite second side.

20 Claims, 2 Drawing Sheets

WHIPSTOCK ASSEMBLY AND METHOD FOR LOW SIDE EXIT

BACKGROUND

Whipstocks are used in the process of drilling a secondary or deflection hole from a cased hole in underground rock or geologic formations. Such secondary holes or windows can be used to change a direction of a wellbore, to provide multiple paths from a single wellbore, or for dealing with formation problems. Prior procedures for milling a window in a casing have included the placement, orientation, and securing of the whipstock and subsequent drilling which has involved many steps. Subsequently, a one-trip window-cutting system was developed and is fully described in U.S. Pat. No. 5,109,924 to Jurgens. The combination of mills preassembled to a whipstock, as illustrated in the Jurgens patent, allowed the milling of the window from start to finish after the whipstock was properly oriented and supported.

In most operations, correct orientation of the whipstock face is required. Typically, if the wellbore has even a slight inclination, the whipstock face is oriented relative to the high side of the hole, and previous systems have only worked with whipstocks set to no more than 60 degrees to the left or right of the high side. The whipstock assembly is oriented using one of an orienting sub, steering tool, surveying device, etc. or by measurement while drilling. The orientation of the whipstock dictates the direction of the window and exit for running drilling bottom hole assemblies, liners, and completion equipment, and therefore the orientation of the whipstock is an important step in the process.

BRIEF DESCRIPTION

A whipstock assembly allowing a lowside casing exit, the whipstock assembly includes a whipstock including an upstream portion and a downstream portion, the upstream portion having a deflection wedge surface and an opposite casing-side surface; and a fulcrum protruding from the whipstock and positioned between the downstream portion and the upstream portion.

A method of allowing a first side exit in a window milling operation of a casing having a first side and an opposite second side, the method includes providing a whipstock assembly including a whipstock having an upstream portion and a downstream portion, the upstream portion having a deflection wedge surface and an opposite casing-side surface, a fulcrum positioned between the downstream portion and the upstream portion, and an anchor positioned at a downstream end of the whipstock; inserting the whipstock assembly in the casing; positioning the anchor closer to the second side of the casing than the first side of the casing during run-in of the whipstock assembly; setting the anchor in the casing; and, levering an upstream end of the whipstock towards the second side of the casing via the fulcrum.

BRIEF DESCRIPTION OF THE DRAWINGS

The following descriptions should not be considered limiting in any way. With reference to the accompanying drawings, like elements are numbered alike:

FIG. 2 depicts a cross-sectional view of an exemplary embodiment of a whipstock assembly in a hole during run-in;

DETAILED DESCRIPTION

A detailed description of one or more embodiments of the disclosed apparatus and method are presented herein by way of exemplification and not limitation with reference to the Figures.

Allowing a low side exit can provide an operator with an optimal exit point, as opposed to restricting the exit to the high side. Flexibility in window location and side exit area provides the operator with the ability to achieve a desired drilling direction to reach an intended target.

Figure 1:
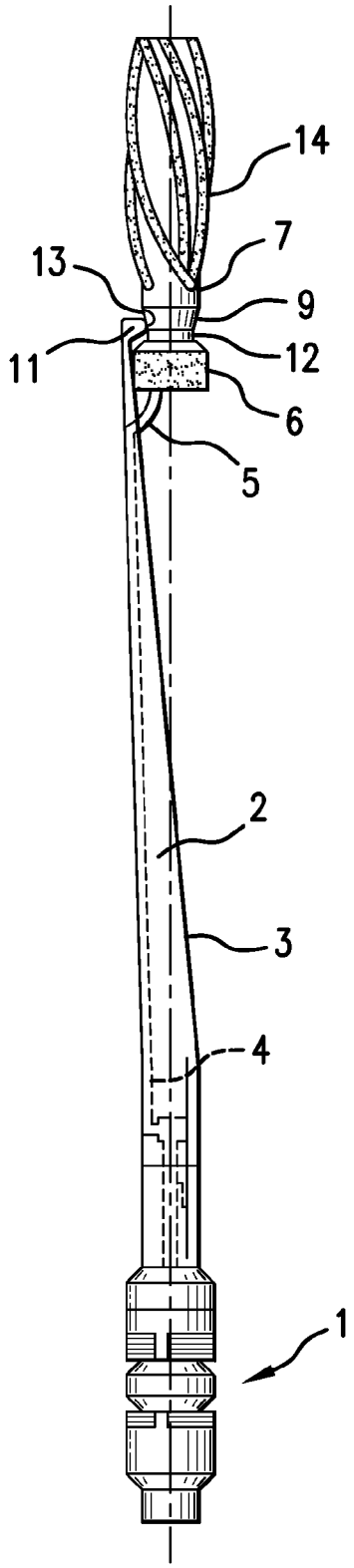
FIG. 1 PRIOR ART
FIG. 1 depicts a partially cut-away, schematic illustration of lower and central portions of one embodiment of a prior art one trip window cutting tool.

The one-trip window cutting tool method and apparatus disclosed by Jurgens in U.S. Pat. No. 5,109,924, which is herein incorporated by reference in its entirety, is shown in part in FIG. 1. FIG. 1 shows an anchor packer 1 and a deflection wedge unit 2, which includes a deflection wedge surface 3. The packer 1 and deflection wedge unit 2 are designed as a complete unit or assembly and are generally set together in the drill hole. The deflection wedge unit 2, with its deflection wedge surface 3, as shown, has a deflection or diversion angle of about 2 to 3 degrees. The deflection wedge surface 3 is comprised of an annealed, high-performance steel so that the pilot cutting tool 6 can be safely directed along it without destroying the wedge unit 2. The deflection wedge unit 2 is linked directly with the packer 1 and includes a hydraulic passage 4 in order to facilitate the setting of the packer 1 in the drill hole.

Moreover, the deflection wedge unit 2 also includes a hydraulic passage 4 whose upper end is joined to a hose 5 with a coupling (not shown). The hose 5 is joined to the pilot cutting tool 6 and thus creates a direct link to the drilling fluid supply.

The pilot cutting tool 6 is mounted to a drill string at its end region and proximate milling tool 7. The leading end of milling tool 7 includes a deflection guide 9, also known as a starter cone, for the pilot cutting tool 6. This deflection guide 9 is of a generally conical shape.

The deflection wedge unit 2, at its upper end near the drill string, includes a deflection ramp 11, which retains the pilot cutting tool 6. The connection between the deflection ramp 11 and the pilot cutting tool 6 is established by a shear bolt connection, generally designated by reference numeral 12, in order to permit the setting and positioning of the deflection wedge unit 2 and the packer 1 with respect to the drill string and the pilot cutting tool 6.

The deflection ramp 11 includes a deflection ramp surface 13 and, at the beginning of the deflection or window cutting process, the lower region of the deflection guide 9 rests against it. In the pilot cutting or deflection starting position, the deflection guide 9 extends over the deflection ramp surface 13 so that the pilot cutting tool 6 can be pivoted via the deflection guide 9 and the deflection ramp surface 13 of the deflection ramp 11 away from the drill hole longitudinal axis without first coming into contact with the deflection wedge surface 3 of the deflection wedge unit 2. The milling unit 14 of tool 7 which is mounted above the pilot cutting tool 6 generally has an outer cutting diameter that is greater than the outer diameter of the pilot cutting tool 6. A constriction is included above the milling unit 14 in the first downstream milling tool 7 forming a flex joint so that the milling tool 7 can be bent to a certain extent and thereby reduce any material stresses due to torsion. A clearing cutting tool (not shown)

follows the tool 7 and includes a milling unit that generally has a cutting outer diameter that essentially corresponds to the required diameter of the finished deflection hole or window being prepared. Of course, other cutting tools or milling units can be provided between the clearing cutting tool and the rest of the drill string if the clearing capacity of the clearing cutting tool is not sufficient for a particular job.

Figure 2:
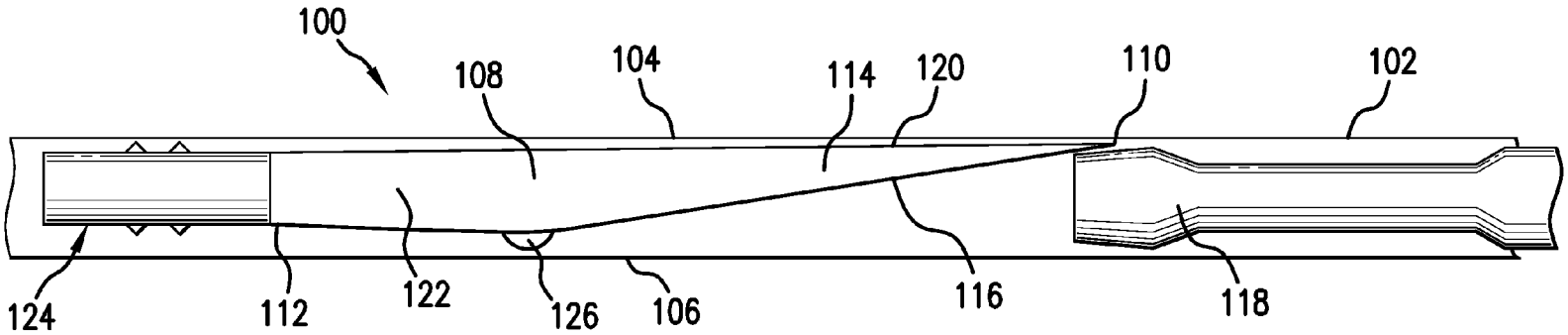

Turning now to FIG. 2, an improved whipstock assembly 100 for allowing a low side exit is shown running in a casing or hole 102 with a high side 104 and a low side 106. For the purposes of description, the high side 104 of the hole 102 is the side of the hole 102, which is closer to the rig floor, or surface and the low side 106 of the hole 102 is the side of the hole 102, which is further from the rig floor or surface. While the whipstock assembly 100 described herein is designed to enable a low side 106 exit, it should be understood that any desired exit direction is made possible with the whipstock assembly 100. The whipstock assembly 100 includes a whipstock 108 having an upstream end 110 and a downstream end 112. An upstream portion 114, adjacent the upstream end 110, includes a tapered deflection wedge surface 116 for guiding a window-milling system 118 and an opposite casing-side surface 120 having a curved outer surface that is slidable along an inner diameter of the hole 102. The window-milling system 118 is connected, attached, or otherwise associated with the upstream portion 114 of the whipstock 108 and may include any or all of a pilot cutting tool, milling unit, clearing cutting tool, etc. The window-milling system 118 includes a tubing string, which supports the cutting and milling tools. Upstream of the window-milling system 118, a known orientation device (not shown) may be attached or otherwise provided with the tubing string. The orientation device can also be run through the tubing string on wireline as an alternative, in which case it may be run in separately from the bottom hole assembly and after milling may be withdrawn separately.

A downstream portion 122 of the whipstock 108, adjacent the downstream end 112, is attached to a packer 124. The packer 124 is intended to encompass all types of whipstock supports, including but not limited to packers, plugs, and anchors. In the illustrated embodiment, the packer 124 includes a hydraulic anchor, which can make use of the hydraulic line 4 and hose 5 as described with respect to FIG. 1 to access the drilling fluid supply.

Figure 4:
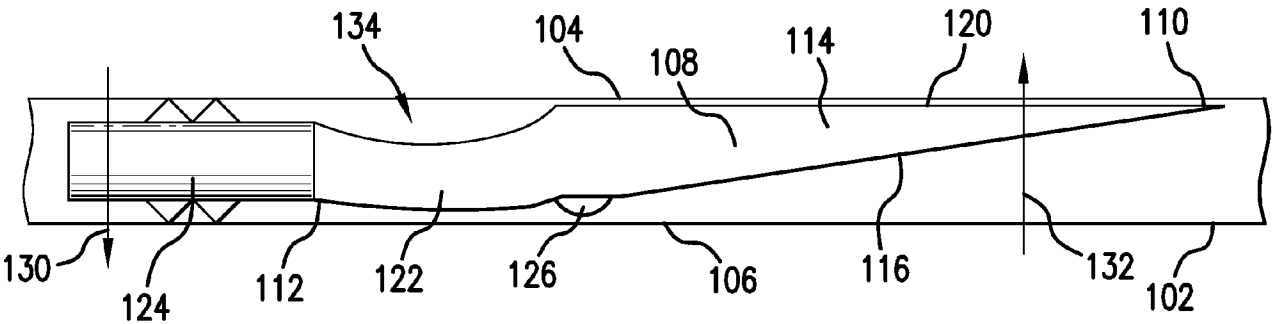
Figure 3:
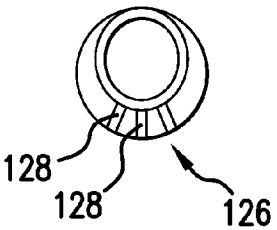
FIG. 3 depicts a cross-sectional view of the whipstock assembly of FIG. 2 at the fulcrum; and, FIG. 4 depicts a cross-sectional view of the whipstock assembly of FIG. 2 in a set condition in the hole.

To successfully allow an exit from the low side 106, the upstream end 110 of the whipstock 108 must be held firm against the high side 104 of the casing 102 and not flop down into the middle of the hole 102. A fulcrum 126 is placed between the upstream end 110, which is the whipstock end, and the packer 124, and more particularly between the downstream portion 122 and the upstream portion 114 of the whipstock 108, at a downstream end of the deflection wedge surface 116. As shown in FIG. 3, in one exemplary embodiment, the fulcrum 126 includes a plurality of spaced fins 128 positioned on and protruding from the whipstock 108 downstream of the deflection wedge surface 116, and on an opposite side of the whipstock 108 as the casing-side surface 120. The fins 128 may include steel blades welded or otherwise secured to the whipstock 108. As shown in FIGS. 3 and 4, the fins 128 have a rounded "D" shape to ease the entry and exit of the whipstock assembly 100 into and out of the hole 102, and are plate-like and spaced apart to allow for the passage of fluids, wireline operations, etc.

With reference again to FIG. 2, before setting the whipstock assembly 100, the whipstock assembly 100 is run in the hole 102 such that the packer 124 will be positioned slightly off center to casing 102. In other words, the packer 124 does not align with a longitudinal axis of the hole 102, and is positioned closer to the high side 104 of the hole 102 than the low side 106. Turning to FIG. 4, when the bottom trip or hydraulic anchor or other packer 124 sets, the resultant force on the downstream side of the fulcrum 126 is downward or towards the low side 106, as indicated by arrow 130. On the upstream side of the fulcrum 126, when the packer 124 is set, the resultant force on the whipstock tip, the upstream end 110 thereof, via the fulcrum 126 will force the whipstock tip against the casing 102 in the direction indicated by arrow 132, which in this case is towards the high side 104 of the casing 102. With the casing-side surface 120, and in particular the upstream end 110 of the casing-side surface 120, forced towards the high side 104 of the casing 102, the deflection wedge surface 116 faces the low side 106 of the casing 102 and the window-milling system 118 can be guided along the deflection wedge surface 116 to successfully complete a window cutting operation on the low side 106 of the casing 102 to provide a lowside casing exit.

In an alternative exemplary embodiment, as shown in FIG. 4, the downstream portion 122 of the whipstock 108 includes a flex joint 134 between the packer 124 and the fulcrum 126. The flex joint 134 allows the packer 124 to set properly while still transferring sufficient force through the fulcrum 126.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A whipstock assembly allowing a lowside casing exit, the whipstock assembly comprising:

a whipstock including an upstream portion and a downstream portion, the upstream portion having a deflection wedge surface and an opposite casing-side surface; and a fulcrum protruding from the whipstock and positioned between the downstream portion and the upstream portion and including a plurality of spaced fins, the fulcrum serving as a support about which the downstream and upstream portion pivot;

wherein, in a set position of the whipstock assembly, a force on the upstream portion is in an opposite direction from a force on the downstream portion.

2. The whipstock assembly of claim 1, wherein the fulcrum is positioned downstream of the deflection wedge surface and on a side of the whipstock opposite the casing-side surface.

3. The whipstock assembly of claim 1, wherein the fulcrum includes a plurality of steel blades welded to the whipstock.

4. The whipstock assembly of claim 1, further comprising a packer attached to the downstream portion of the whipstock, wherein setting the packer in a casing levers an upstream end of the whipstock towards a side of the casing via the fulcrum.

5. A whipstock assembly allowing a lowside casing exit, the whipstock assembly comprising:

a whipstock including an upstream portion and a downstream portion, the upstream portion having a deflection wedge surface and an opposite casing-side surface;

a fulcrum protruding from the whipstock and positioned between the downstream portion and the upstream portion; and, a packer attached to the downstream portion of the whipstock, wherein a longitudinal axis of the packer is offset from a longitudinal axis of a casing in an unset condition of the packer.

6. The whipstock assembly of claim 5, wherein the packer is positioned closer to the high side of the casing than the low side of the casing in the unset condition of the packer.

7. The whipstock assembly of claim 5, wherein the longitudinal axis of the packer substantially aligns with the longitudinal axis of the casing in a set condition of the packer.

8. The whipstock assembly of claim 7, wherein the downstream portion of the whipstock includes a flex joint which allows the packer to set in the casing.

9. The whipstock assembly of claim 5, wherein the downstream portion includes a flex joint.

10. The whipstock assembly of claim 9, wherein the flex joint is located between the fulcrum and the packer.

11. The whipstock assembly of claim 5, wherein the packer is a settable whipstock support and includes an anchor.

12. The whipstock assembly of claim 5, wherein the fulcrum is positioned at a downstream end of the deflection wedge surface and spaced from the packer.

13. A method of allowing a first side exit in a window milling operation of a hole or casing having a first side and an opposite second side, the method comprising:

inserting a whipstock assembly in the hole or casing, the whipstock assembly including a whipstock having an upstream portion and a downstream portion, the upstream portion having a deflection wedge surface and an opposite casing-side surface, a fulcrum positioned between the downstream portion and the upstream portion, and a whipstock support including at least one of an anchor and a packer positioned at a downstream end of the whipstock;

positioning the whipstock support closer to the second side of the hole or casing than the first side of the hole or casing during run-in of the whipstock assembly;

setting the whipstock support in the hole or casing; and, levering an upstream end of the whipstock towards the second side of the hole or casing via the fulcrum.

14. The method of claim 13, wherein the whipstock assembly includes a plurality of spaced fins attached to the whipstock at a downstream end of the deflection wedge surface as the fulcrum.

15. The method of claim 13, wherein the whipstock assembly includes a flex joint between the fulcrum and the whipstock support.

16. The method of claim 15, wherein setting the whipstock support includes flexing the flex joint and substantially aligning a longitudinal axis of the whipstock support with a longitudinal axis of the hole or casing.

17. The method of claim 13, wherein setting the whipstock support includes substantially aligning a longitudinal axis of the whipstock support with a longitudinal axis of the hole or casing.

18. The method of claim 13, further comprising running in a milling device with the whipstock assembly in a one-trip window-milling method.

19. The method of claim 18, further comprising cutting a window in the first side of the hole or casing.

20. The method of claim 19, wherein the first side is a low side of the hole or casing.

* * * * *